United States Patent [19]

Jakobs

[11] Patent Number: 4,838,494

[45] Date of Patent: Jun. 13, 1989

[54] ROLLER MILL, PARTICULARLY ROLL PRESS OR ROLL JAW CRUSHER

[75] Inventor: Willy Jakobs, Cologne, Fed. Rep. of Germany

[73] Assignee: Klöckner-Humboldt-Deutz Aktiengesellschaft, Fed. Rep. of Germany

[21] Appl. No.: 150,845

[22] Filed: Feb. 1, 1988

[30] Foreign Application Priority Data

Feb. 18, 1987 [DE] Fed. Rep. of Germany ..... 3705051

[51] Int. Cl.[4] ..... B02C 4/02; B02C 23/00

[52] U.S. Cl. ..... 241/226; 99/621; 100/155 R; 241/285 A; 241/290; 425/237; 425/363

[58] Field of Search ..... 241/226, 101.2, 285 A, 241/285 B, 289, 290; 100/155 R, 157, 160, 176; 425/363, 369, 406, 237; 99/621

[56] References Cited

U.S. PATENT DOCUMENTS

| | | | |
|---|---|---|---|
| 331,017 | 11/1885 | Wild | 241/226 |
| 1,050,183 | 1/1913 | Wall | 241/226 |
| 1,961,291 | 6/1934 | Guillo | 241/226 |
| 2,331,929 | 10/1943 | Pembroke | 241/226 |
| 2,656,986 | 10/1953 | Brasington | 241/226 |

*Primary Examiner*—Joseph M. Gorski

*Attorney, Agent, or Firm*—Hill, Van Santen, Steadman & Simpson

[57] ABSTRACT

A roller mill such as a roll press or roll jaw crusher with crushing rollers and end face plates for lateral limitation of the nip mounted with pivotal links on the side walls of a product delivery chute and triangularly spaced support springs for the face plates urging them toward the nip with wear-resistant coatings on the inner surface of the face plates with the face plates having a lower removable extension.

3 Claims, 1 Drawing Sheet

ROLLER MILL, PARTICULARLY ROLL PRESS OR ROLL JAW CRUSHER

BACKGROUND OF THE INVENTION

The invention relates to improvements in roller mills such as a roll press or roll jaw crusher having face plates positioned at the lateral ends of the nip.

In roller mills heretofore known, such as roller briquette presses and roll jaw crushers, face plates have been located rigidly supported on the product delivery chute with their surfaces facing the ends of the nip. In these structures, the rigid connection of the face plate resulted in a rigid positioning of the plates relative to the nip and jammings between the roller and face plate occurred during operation of the roller mill. This was particularly true when with variation in loads, the rollers would tend to shift positions so that possibly one roller assumed an oblique position relative to the other roller. Such jammings resulted in a necessary operational shut-down of the roller mill and loss of production during such shut-down periods. The face plates, rigidly arranged at the ends of the rolls, were subject to high wear and required frequent replacement with the necessary involved expense of shut-down time and cost of material, servicing and parts.

It is accordingly an object of the present invention to provide a roller mill wherein the face plate construction enables disruption-free continuous operation for long periods of time and eliminates problems heretofore present such that of jamming of material between the roller and the face plates and such as that of rapid and excessive wear of the face plates.

A further object of the invention is to provide an improved roller mill construction having uniquely related face plates which provide for a better product in that they remain effective in their operation throughout their operating life, which operating life is longer than heretofore possible with structures which have been available.

FEATURES OF THE INVENTION

The foregoing objectives are achieved and the problems are solved in that face plates are arranged in an elastically resilient manner at the ends of the nip between the rollers. An arrangement is provided wherein the face plates are supported on the side walls of the product delivery chute permitting yieldable movement in an axial direction relative to the rollers. In this manner, the rollers can move in adjustment of the nip and can even assume angular positions relative to one another when variances in grinding load occur or when noncrushable materials pass between the rollers. When instances occur such as that the rollers must shift, the face plates will automatically adapt to the change in position of the rollers until the load between the rollers or the materials which have caused the rollers to shift passes through and then the face plates automatically resume their normal effective limiting position with their inner surfaces parallel to the ends of the roll retaining the materials in the nip. The arrangement of the face plates not only prevents jammings between the rollers at the face plates and not only automatically resume normal effective operating position with change in position of the rollers, but the plates need to be replaced considerably less frequently in comparison to arrangements heretofore available.

German Patent No. 34 07 534 discloses a roller mill for pressure comminution of brittle materials wherein face plates are provided that can be adjusted toward one another or away from one another and are arranged for lateral limitation of the nip. This structural arrangement, however, is only intended to make it possible to adapt the face plates to the readjustment or changing of the roller mill and to accommodate different grinding stock and to permit adjustments with change in throughput performance of the roller mill due to change in conditions.

In accordance with the principles of the invention, the face plates are detachably connected or supported to the side walls of the product delivery shaft. This permits the face plates to be replaced as needed in a simple and cost-saving manner.

In order to significantly increase the useful life of the face plates, a further improvement of the present concept provides that the face plates are equipped with a highly wear-resistant material, particularly in the lower portion, and the wear-resistant material can be graduated in thickness or wear-resistant capability in accordance with the wear which experience shows occurs as the product enters the nip. Also, the plates are arranged in multiple parts so that the lower part which wears most quickly can be separately changed and serviced.

Other objects, advantages and features of the invention will become more apparent with the teaching of the principles thereof in connection with the disclosure of the preferred embodiment in the specification, claims and drawings, in which:

DESCRIPTION

Figure 1:
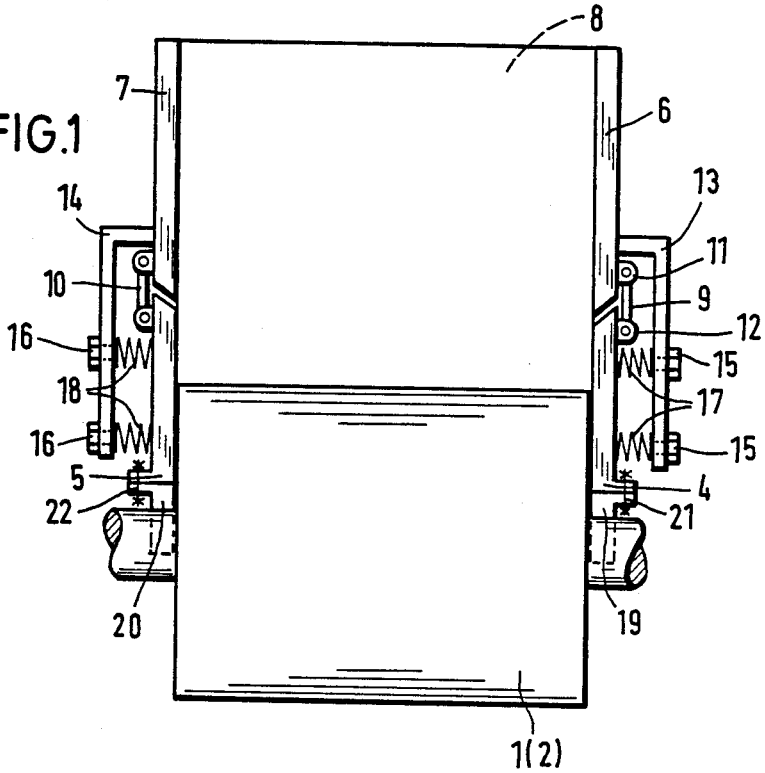
FIG. 1 is a front elevational view of a roller press shown with parts removed and constructed and operating embodying the principles of the present invention.
Figure 2:
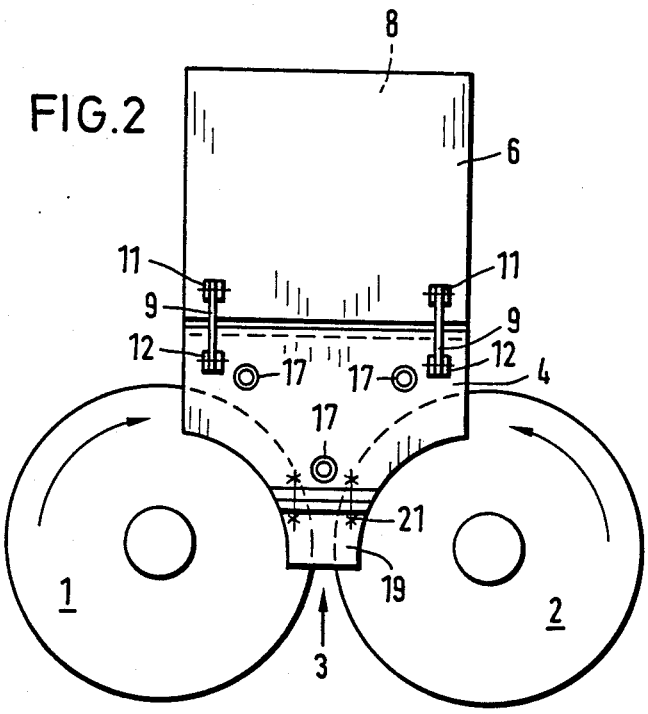
FIG. 2 is an end elevational view of the structure of FIG. 1.

As illustrated in FIGS. 1 and 2, the roller mill shown includes oppositely driven rollers 1 and 2 rotatably supported in suitable bearing in a machine housing. The rollers define between them a nip 3 arranged so that meal to be treated passes downwardly into the nip to be crushed and discharged in a downward direction, with the rolls rotating in the direction indicated by the arrowed lines on the ends of the rolls in FIG. 2.

At the ends of the nip 3 are face plates 4 and 5 which limit the nip and hold the material being ground and crushed within the nip. The inner surfaces of the face plates 5 are flat and essentially co-planar with the end faces of the rollers 1 and 2, slidably engaging the ends of the rollers to prevent the escape of meal laterally out from the axial ends of the nip.

Material is delivered to the nip from a product delivery shaft or chute 8 having side walls 6 and 7.

The face plates 4 and 5 are supported on and mounted on the side walls by a unique support arrangement including pivotal links 9 and 10. The pivotal links are pivotally supported on their upper ends at 11 and are connected to the face plates pivotally at their lower ends 12. As a result of this articulated support of the face plates on the side walls 6 and 7 of the chute, the face plates are yieldably supported by this articulated connection being free to move in and out and tilt about a horizontal axis transverse of the axis of the rollers.

When an oblique positioning of a roller occurs during operation of the roller mill or when materials penetrate between the rollers and the face plates, this articulated support forms a releasable connection for the face plates on the product chute. This arrangement also enables them to be replaced as needed and reserviced quickly with minimum outlay for down-time and expense.

In accordance with the principles of the invention, the face plates 4 and 5 are elastically and yieldably supported against the ends of the rollers, against the end of the nip, such as by spaced springs 17 and 18. These springs are supported on rigid brackets 13 and 14 supported on the side walls 6 and 7 of the supply chute. Because of this elastically resilient support of the face plates 4 and 5 by the springs which push them inwardly in an axial direction, the face plates can yield with shifting movement of the rollers such as when one roller takes an oblique position relative to the other or with given overloads and this movement is permitted to avoid damage or destruction of the plates or of the rollers.

The wear of the face plates 4 and 5 is also considerably reduced in this manner and thus the useful life of the face plate is correspondingly increased.

Since the face plates 4 and 5, particularly in their middle and lower regions, are exposed to particularly high wear during operation of the roller mill, each face plate is constructed to be in multiple parts. In particular, the face plates have a lower extension part 19 and 20. These lower parts are mounted on the upper parts of the face plates by bolts 21 and 22. These bolts are removable for replacement of the lower parts and in one contemplated form, the bolts extend through elongate holes so that the lower inner surfaces of the face plates can be aligned to be co-planar with the inner surfaces of the upper parts of the face plates. This provides the advantage that with expected wear of the face plates in the lower region, only the lower parts 19 and 20 need be replaced and not the overall face plates.

Further, the bolts 21 and 22 permit adjustment of the lower parts of the face plates with wear to bring their inner surfaces into the proper position with wear. The adjustment can be continued until wear occurs to the extent where a planar surface no longer remains and lateral sealing of the nip 3 is inadequate. Then the plates can be discarded and be replaced by new extension face plates. This not only enables a further significant increase in useful life of the face plates, but produces a considerable saving of material and costs.

It is further contemplated that the face plates 4 and 5 can be coated with a wear-resistant material on their inner surface and that their extensions can also be coated. In one form, the wear-resistance of the coating or the thickness of the coating can be increased in a downward direction so that the wear-resistance increases downwardly as a function of the expected wear. The coating can be arranged so that a highly wear-resistant layer can be coated in the middle and lower regions.

The support springs which urge the face plates inwardly are shown at 17 and 18 and are triangularly arranged with a lower spring directly opposite the nip in the center thereof and laterally spaced upper springs adjacent the links 9. The springs are supported on the rigid brackets 13 and 14 by spring connecting bolts 15 and 16. This arrangement of the springs has been found to be advantageous and balances the expected lateral pressures of the meal in the nip.

Thus, it will be seen that I have provided an improved mill arrangement which meets the objectives and advantages above set forth and provides a structure which not only reduces the costs in terms of accommodating wear but provides for more satisfactory operation thereby improving the nature of the product produced by the mill.

I claim as my invention:

1. A roller mill for receiving stock between rolls, comprising in combination:

a pair of rotatably supported rolls adapted to be driven in opposite directions with their upper surfaces moving toward each other for receiving stock in the nip therebetween in a pressing operation;

a vertical chute extending downwardly toward the nip and positioned for directing stock downwardly into the nip;

rigid supporting arms extending downwardly from sides of the vertical chute;

face plates having vertical planar surfaces at ends of the nip for defining said ends and confining material drawn into the nip from the chute;

a pivotal mount for each of said plates for supporting the plates on the chute;

a wear resistant lining on an inner surface of each of the face plates;

a lower extension plate mounted at each lower end of the face plates and facing the center of the nip;

means for adjusting the location of the lower end of each of the face plates and for removably mounting the lower extension plates on the face plates; and coil compression springs for each face plate between said rigid supporting arms and each face plate to separately resiliently urge the face plates toward the nip, said springs being triangularly arranged for each face plate with a lower spring facing the nip and two upper springs being spaced apart.

2. In a roller mill for receiving stock between rolls constructed in accordance with claim 1:

wherein said wear-resistant lining is graduated in wear-resistant capabilities increasing in wear-resistance in a downward direction toward the nip.

3. A roller mill for receiving stock between rolls constructed in accordance with claim 1:

wherein each pivotal mount includes spaced links pivotally mounted at their upper ends on the chute and at their lower ends on the face plates.

* * * * *